United States Patent [19]

Bell et al.

[11] Patent Number: 4,936,456

[45] Date of Patent: Jun. 26, 1990

[54] BAG ARRANGEMENT

[75] Inventors: Gary M. Bell, Crystal, Minn.; Cecil E. Richison, Hudson, Wis.; Paul W. Gazillo, Roselle, Ill.

[73] Assignee: Kapak Corporation, St. Louis Park, Minn.

[21] Appl. No.: 334,786

[22] Filed: Apr. 6, 1989

Related U.S. Application Data

[63] Continuation of Ser. No. 180,527, Apr. 12, 1988, abandoned.

[51] Int. Cl.[5] ..... B65D 33/01

[52] U.S. Cl. ..... 206/439; 206/631; 206/632; 206/633; 206/484.1; 383/102; 383/120

[58] Field of Search ..... 383/78, 93, 94, 102, 383/120; 206/610, 613, 631, 632, 633, 439, 484.1

[56] References Cited

U.S. PATENT DOCUMENTS

| | | | |
|---|---|---|---|
| 3,070,225 | 12/1962 | Schwartz | 206/633 X |
| 3,181,583 | 5/1965 | Lingenfelter | 206/632 X |
| 3,410,393 | 11/1968 | Lee | 206/632 X |
| 3,738,566 | 6/1973 | Foster | 206/632 |
| 3,851,814 | 12/1974 | Stage | 383/94 |
| 4,146,133 | 3/1979 | Bogorad et al. | 206/632 X |
| 4,402,453 | 9/1983 | Regenstein, Jr. | 206/439 X |
| 4,624,407 | 11/1986 | Janhonen | 383/120 X |
| 4,644,732 | 2/1987 | Morton | 206/613 X |
| 4,718,738 | 1/1988 | Bell . | |
| 4,781,297 | 11/1988 | Abrahamsson et al. | 383/120 X |

FOREIGN PATENT DOCUMENTS

| | | | |
|---|---|---|---|
| 2240483 | 3/1973 | Fed. Rep. of Germany | 206/439 |
| 1545797 | 10/1968 | France | 383/120 |
| 647209 | 1/1985 | Switzerland | 383/102 |

OTHER PUBLICATIONS

Seiyu bag.
Bag with no English language words, decorated with a drawing of a mill.
Kikkoman Tofu bag.

*Primary Examiner*—Stephen Marcus
*Assistant Examiner*—Jes F. Pascua
*Attorney, Agent, or Firm*—Merchant, Gould, Smith, Edell, Welter & Schmidt

[57] ABSTRACT

A bag construction is provided. In the preferred embodiment, the bag construction or arrangement comprises first and second side panels, and first and second edge gusset members. The gusset members are peelable from between the side panels; peeling being facilitated by positioning of end tab extensions at both ends of each gusset member. In a preferred embodiment, both side gusset members comprise a gas-permeable material of sufficient density to act as a contaminant filter, so that contents within the bag arrangement can be sterilized by a gas sterilization procedure.

29 Claims, 2 Drawing Sheets

BAG ARRANGEMENT

This is a continuation-in-part continuation, of application Ser. No. 07/180,527, filed 4/12/88 now abandoned.

FIELD OF THE INVENTION

The present invention relates to bags, sacks or pouches. For a preferred embodiment, the invention concerns a high-profile, sterilizable, bag arrangement having features providing for ease of opening.

BACKGROUND OF THE INVENTION

A very wide variety of bag and/or pouch constructions are well-known, for a variety of uses. The present invention particularly concerns bags or pouches used for the containment of articles or products. For example, a consumer product may be distributed and/or sold in a protective bag according to the present invention.

Such bags or pouches are conventionally sealed in a variety of manners, including with heat sealing, adhesives, mechanical fasteners and similar arrangements. Preferred embodiments of the present invention particularly concern pouches which are heat sealed, although other sealing methods may be used in embodiments involving the principles of the invention.

For many applications it is desirable to maintain an enclosed article substantially sterilized, prior to use. In some instances, items must be sterilized with heat, prior to being sealed within a pouch or the like. While this method of sterilization is effective for some uses, for many it is inappropriate. Reasons for this include: costs; potential damage to certain products or packages from sterilizing heat; and, inconvenience, especially with mass-manufacture processes.

It is also known that sterilization can be effected through the utilization of gas treatments such as with ethylene oxide. In a typical application, a pouch including a gas-permeable wall section is prepared, and the item to be sterilized is placed within the bag. The bag is then sealed. The sealed bag is placed in an ethylene oxide environment. The ethylene oxide can permeate the gas-permeable wall section, sterilizing the inside of the bag and products enclosed therein. If an appropriate gas-permeable material is selected, then bacteria cannot readily pass through the wall section, to re-contaminate the inside of the bag and/or products contained therein. That is, the gas-permeable material acts as a filter. As a result, the sealed product can be stored in a non-ethylene oxide environment, for a substantial period of time, without substantial contamination of the enclosed item.

A variety of pouch constructions have been developed which include gas-permeable wall sections therein, for gaseous sterilization. In some such systems, generally one end or edge of the bag comprises a "header" of the gas-permeable material. Such conventional arrangements have generally not been fully acceptable for numerous reasons. First, the arrangements using them have been relatively expensive to construct. Secondly, substantially complete equilibria within the bag, to obtain ethylene oxide penetration throughout substantially all portions of the bag and the enclosed items, has been slow to develop. Also, conventional pouch structures have not readily accommodated high-profile items, i.e. items which have a substantial thickness and require a bag to expand a considerable amount to be fit therearound.

A variety of materials can be utilized as the gas-permeable wall section. In general, what is required is a material: sufficiently strong and pliable for use as a portion of a pouch or the like; sufficiently permeable to gas; and, which acts as a filter to prevent passage of recontaminating bacteria or the like therethrough. Spunbonded high density polymeric (esp. polyethylene or polypropylene) materials, such as TYVEK (Dupont) are particularly well adapted for such uses.

Numerous other features are desirable in bag or pouch constructions, for certain applications. Some of these relate to, or concern, the following:

1. For some applications it is desirable that the pouch be expandable, to accommodate products of a variety of profiles. That is, it is desirable that the bag be such as can be easily expanded, and retained opened to receive an item or items therein. Some conventional arrangements, utilizing side gussets, have been developed to accommodate this. In general, these side gussets have been formed in bags of unitary structure, having a single seam therein. The seam, in general, has been placed along a side edge or back portion of the bag. The side gussets generally comprise an inward > or < shaped gusset in the sides of the pouch. Such gussets can act as a hinge, allowing front and back panels of the pouch to be collapsed toward or away from one another, in an accordion-like fashion. As a result of such arrangements, high-profile items can be easily stored within the bag.

2. In many instances, it is desirable that sealed bags, having products stored therein, include means facilitating easy opening. A variety of structures to accommodate these have been developed, including tear lines and notches.

As previously indicated, a very wide variety of bag or pouch designs have been developed. Many of these designs are well-suited for a variety of applications. However, improved designs have been needed to better accommodate: features for easy expandability to accommodate high-profile items stored therein; features facilitating easy opening; and, features facilitating utilization of a variety of materials, such as gas-permeable materials, for side panel members especially when such materials differ from the materials utilized for front and back panels in the pouch.

OBJECTS OF THE INVENTION

Therefore, the objects of the present invention include: the provision of a bag or pouch construction utilizing at least one and preferably two accordion-like side gusset members constructed from material which is not unitary with front and back panels of the pouch; to provide a preferred such arrangement wherein at least one side gusset member comprises a gas-permeable material utilizable to facilitate a sterilization process for materials stored within the pouch; to provide a preferred such arrangement having two opposite gusset members both of which comprise a gas-permeable material; to provide a preferred arrangement, for a pouch having accordion-like side gusset members, which includes means facilitating ease of opening; to provide a preferred pouch construction having gas-permeable, accordion-like, side gusset members for sterilization, and including means facilitating ease of opening; and, to provide such a preferred pouch construction which is relatively easy and relatively inexpensive to effect, and which is particularly well-adapted for the proposed usages thereof.

Other objects and advantages of the present invention will become apparent from the following descriptions, taken in connection with the accompanying drawings, wherein are set forth by way of illustration and example various embodiments of the present invention.

SUMMARY OF THE INVENTION

A pouch or bag construction is provided with a side panel arrangement which includes front and back panels, and at least one and preferably two, opposite, side gusset members. At least one, and preferably both, of the side gusset members is constructed non-integral (i.e. non-unitary) with the front and back panels. That is, at least one, and preferably both, of the side gusset members comprises a piece of material independent of the front and back panels, and attached to the front and back panels by means of a heat seal, adhesive or the like. Preferably the side gusset members have elongate, inwardly directed, hinge folds, to facilitate expansion of the bag, in an accordion-like manner, to accommodate the storage or containment of highprofile items therein.

As a result of the material utilized for the side gusset(s) being non-integral with the front and back panels of the pouch or bag construction, a number of advantages are provided. For example, the side gusset(s) may be constructed from a different type of material then are the front and back panels. Also, means facilitating easy opening of the bag construction, are provided.

There are a number of reasons why it might be desirable to have a side gusset construction such that the side gusset(s) can be made from a different piece of material than the front and back panels of the bag. For example, decorative strips, printed in a manner different than the front and back panels, can be readily utilized. A particular advantage of bag constructions according to the present invention is that the side gusset may be constructed from a material such as TYVEK (DuPont), i.e., a gas-permeable material resistant to bacteria (contaminant) passage therethrough. As a result of side gusset construction from such a material, pouches or bags according to the present invention are particularly well suited for utilization to store items therein that are to be kept sterile; for example, hospital gowns and equipment such as catheters, etc. If a relatively stiff material is used for side gussets, means are provided which help keep the bag held open.

The expandable side gusset construction of the preferred embodiment not only facilitates introduction of gas-permeable material therein, for use in sterilization processes, but it also facilitates the sterilization process itself. A reason for this is that it allows the bag to be opened or expanded considerably facilitating good, efficient, permeation by the sterilizing gas, for example ethylene oxide. In a preferred construction, oppositely located gas-permeable gusset members are positioned within the bag construction to facilitate rapid permeation of the sterilizing gas to substantially all portions of the internal volume.

Bag constructions according to the present invention include means facilitating ease of opening. In particular, since at least one of the side gusset members is non-integral (i.e. non-unitary) with the front and back panels between which it is mounted, the pouch can be opened by stripping or removal of this gusset member. This is facilitated by two features comprising: a grab-tab or pull-tab arrangement or extension facilitating gripping of the side gusset, to strip same from its position in the unopened bag or pouch, i.e. from between the front and back panels; and, use of a release coat material in association with seams, typically on the side gusset(s) to facilitate stripping from sealing association with the front and back panels. These features will be further understood by reference to the detailed description below.

Preferred bag or pouch constructions according to the present invention comprise: front and back panels of material(s), such as plastic material, which is heat sealable; elongate side gusset members having an internally directed hinge fold therein; edge-to-edge heat seals or seam arrangements directed between opposite side gusset members, and generally enclosing ends of the bag construction by sealing the front and back panels to one another; elongate side edge seals or seam arrangements extending along four edges of the bag construction, each edge being a seam whereat a side gusset member is attached to one or the other of the front and back panels; release coat means associated with each seal between a side gusset member and a front or back panel; and, a pull-tab arrangement or extension whereby a side gusset member can be easily grabbed or gripped for stripping from the bag construction. As will be understood from the detailed descriptions, especially upon comparison of the various embodiments depicted, the edge-to-edge seals need not be linear and they need not be perpendicular to the gusset members.

The drawings constitute a part of this specification and include exemplary embodiments of the present invention, while illustrating various objects and features thereof. It will be understood that in some instances relative component sizes and material thicknesses may be shown exaggerated, in order to facilitate an understanding of the invention and to clarify the drawings.

DETAILED DESCRIPTION OF THE INVENTION

As required, detailed embodiments of the present invention are disclosed herein. It is to be understood, however, that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed system or structure.

Figure 1:
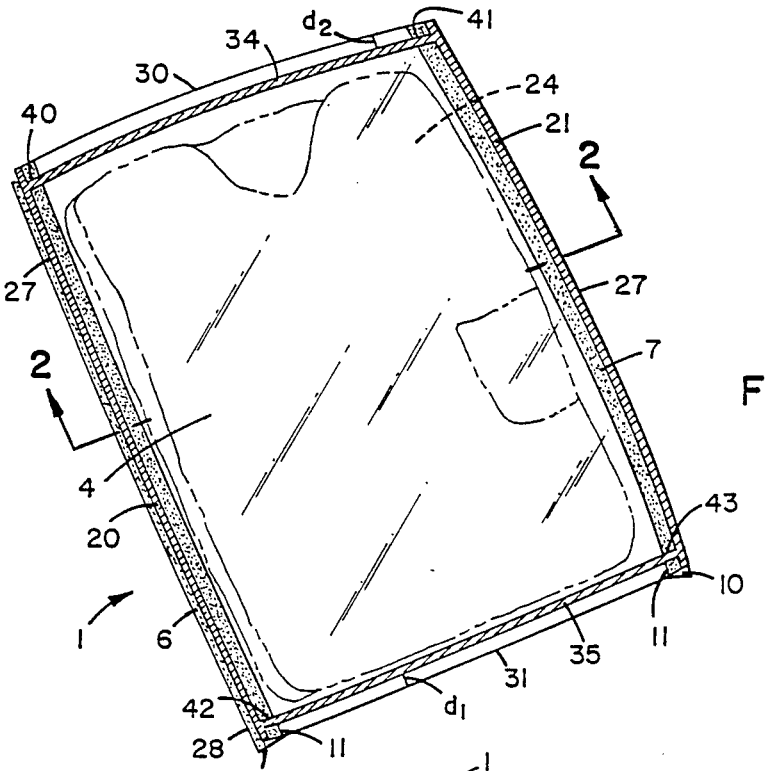
FIG. 1 is a perspective view of a bag construction according to the present invention shown sealed closed with a relatively high-profile article received therein.

The reference numeral 1, FIG. 1, generally designates a bag or pouch arrangement or construction according to the present invention. As used herein, the terms "bag", "pouch" and variants thereof are meant to refer to a flexible enclosure arrangement, i.e., a sack-like arrangement inside of which an article may be enclosed. Typically, bags or pouches according to the present invention are utilized for the storage and protection of consumer items. That is, items of interest are sealed within the bag or pouch, during a packaging operation, and are then shipped to distributors, wholesalers, retailers, consumers, etc. When desired, the bags are torn open to gain access to items received therein.

The bag remnants, following opening, are generally to be disposed of, rather than recycled or reused. Thus, designs which are relatively inexpensive to effect are preferred.

Figure 2:
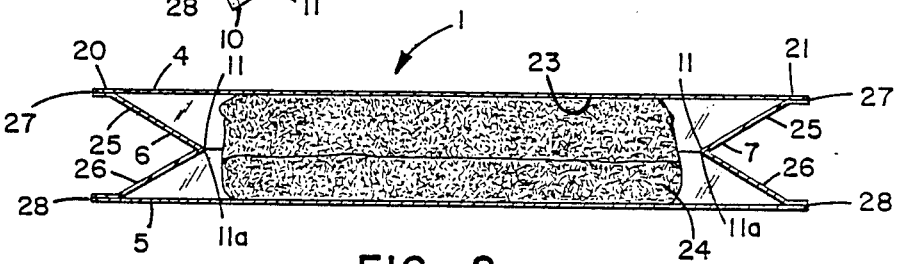
FIG. 2 is a cross-sectional view taken generally along line 2—2, FIG. 1.

Referring to FIG. 2, bag 1 comprises first and second opposite sides of panels 4 and 5, and first and second opposite side gussets 6 and 7. Panels 4 and 5 generally comprise front and back panels of bag 1. The panels can be formed from a variety of materials, including paper, polymeric films or the like. The panels 4 and 5: can include advertising or decorative indicia thereon; they may be colored; and, they may be formed from transparent, translucent, opaque or non-light transmissive materials. There is no requirement that panels 4 and 5 be constructed from the same material. It is foreseen that in typical applications, panels 4 and 5 will comprise a conventional, heat-sealable, substantially transparent plastic material such as a polyethylene or polypropylene plastic. Such materials are conventionally utilized for storage bags; they are readily available from a variety of sources; they are relatively inexpensive; and, they are easily handled.

Many of the advantages of the present invention are derived from the following features: the shape of the side gusset members 6 and 7; the fact that at least one, and preferably both, of the side gusset members 6 is 7 are non-integral (i.e. non-unitary) with both of panels 4 and 5; and, the nature of the seals among the panels 4 and 5, and the gussets 6 and 7. For a preferred embodiment, certain advantages are obtained from the particular material chosen for construction of the side gussets 6 and 7. Details concerning these features, and the advantages derived therefrom, will be apparent from the following.

Referring to FIGS. 1 and 2, each of side gussets 6 and 7 comprises an elongate strip 10 of material. Each includes a longitudinal, substantially centrally disposed, hinge fold 11. Referring to FIG. 1, the strips 10 are positioned between panels 4 and 5 to extend along opposite side edges 20 and 21 of the bag 1, with hinge folds 11 defining central hinge lines 11*a* generally directed inwardly of the bag 1. That is, referring to FIG. 2, the hinge folds 11 are directed toward an interior 23 of the bag 1, wherein for typical use an article 24 is located. The hinge-folds of each extension define a pair of flaps or gusset panels 25 and 26.

Referring to FIGS. 1 and 2, each gusset 6 and 7 is sealed between opposite panels 4 and 5, along seal or seam lines 27 and 28, preferably by means of a preferred seam arrangement as described.

A variety of edge seam arrangements seal or seam types may be utilized along lines 27 and 28. For typical applications, a heat seal or adhesive seal will be used, most preferably a heat seal. Heat seals can be easily produced; they are not messy to create; and, they are relatively sturdy.

Also, preferably seals or seams 27 and 28 are peelable. That is, under an appropriate tearing stress, the materials joined at seams 27 and 28 can be readily stripped apart from one another. Conventional "peelable" seals or seams are well-known, and can be achieved in a variety of manners. Typically, they are accomplished by providing one or both of the materials joined at the seam with a release coat thereon. A variety of conventional release coats are known and materials having them are commercially available. Preferably, all that is required to obtain advantages according to the present invention is that the seals 27 and 28 be such that they can be peeled by human hand, without excessive force, and that they otherwise be operable to provide a good environmental seal for protection of article 24 stored within bag 1. The term "peelable" and variants thereof, as used herein, is meant to refer to a seam readily openable upon application of such force such as may be readily applied by a person of about ordinary strength.

Referring to FIG. 1, bag 1 includes opposite ends 30 and 31. Generally, at ends 30 and 31, FIGS. 1 and 3, opposite panels 4 and 5 abut one another. Panels 4 and 5 are joined to one another along end seam arrangements end seams or seals 34 and 35. A variety of methods of providing for seals 34 and 35 may be utilized. It is foreseen that for typical, preferred, embodiments seals 34 and 35 will be heat seals, which again are relatively inexpensive to obtain and are relatively sturdy in construction.

Figure 3:
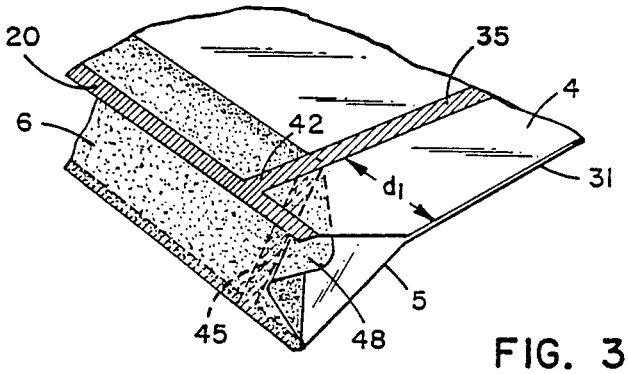
FIG. 3 is an enlarged fragmentary perspective view of a corner portion of the arrangement shown in FIG. 1.

Referring again to FIG. 1, it is noted that in corner sections of the bag construction 1, seals 34 and 35 each include four extensions, whereat they extend into conjunction with gusset panels 25 and 26 of the side gussets 6 and 7. In particular, FIG. 1, for panel 4, seal 34 includes two upper extensions 40 and 41, and seal 35 includes two upper extensions 42 and 43. Lower extensions are not viewable in FIG. 1, but will be understood to be analogous to the upper extensions. Extension 42 is more clearly viewable, in the fragmentary perspective view of FIG. 3. From FIG. 3 it will be understood that each extension, for example extension 42, comprises a point of sealing or bonding in the direction of the associated seal, (seal 35 in FIG. 3), between the side gusset (6) and the associated panel, (panel 4 in FIG. 3). In FIG. 3 a lower extension 45, comprising the analogue to extension 42 is shown in phantom lines. It will be understood that for the embodiment of FIGS. 1 and 3 each upper extension 40, 41, 42 and 43 has an analogous lower extension.

As a result of the edge seals 27 and 28, the end seals 34 and 35, and the seal extensions (upper extensions 40, 41, 42 and 43 and their analogues), an article 24 enclosed within bag construction 1 is sealed therein.

It is noted that while seals 34 and 35 between panels 4 and 5 could be made peelable, for the embodiment shown in FIG. 1 no particular advantage would be obtained therefrom. That is, it is desirable to be able to strip the side gussets 6 and 7 in order to open the bag 1, but there is no particular need, for many uses, to be able to easily strip panel 4 from panel 5. It is also noted that if strips 6 and 7 include a release coat thereon, then the extensions, (extensions 40, 41, 42 and 43, FIG. 1, and their analogues) will also be peelable.

In preferred embodiments, means are provided to facilitate stripping or peeling of at least one of the side gussets 6 and 7 from between the panels 4 and 5. Referring to FIG. 3, for preferred embodiments, this is accomplished by providing a substantial distance between an end seal and an associated bag end. Referring to FIG. 3, this is indicated by $d_1$ between end edge 31 and seal 35. In FIG. 1, it is also represented by $d_2$, between end edge 30 and seal 34. Referring to FIG. 3, as a result of this substantial distance $d_1$, each strip, for example strip 6, is provided with a tab section 48 that can be easily gripped and manipulated. In general, a distance $d_1$ and/or $d_2$ (FIG. 1) of about 0.5 to 1.5 inches, and preferably about 0.75 to 1.0 inches, is preferred for ease of gripping. A substantially smaller, i.e., less than about 0.5 inch, tab, or extension 48 would be difficult to easily grasp. A substantially larger (i.e., greater than about 1.5 inch) tab would be operable, but for many applications it would arguably involve a waste of material, i.e., a cutting down of the interior volume 23 of the bag 1, without provision of substantial advantage. In one alternate embodiment however, a relatively long tab is shown, providing for advantage, FIG. 6.

It is noted that advantages may be obtained by providing a pull tab such as tab 48 only at one end, either end 30 or end 31, of the bag 1. That is, a gusset 6 or 7 could easily be peeled if a pull tab is located at only one end thereof. Such an arrangement would allow for greater internal volume 23 with the same amount of outside material. In typical embodiments, however, pull tabs will be provided at opposite ends, i.e., ends 30 and 31, so that a user need not search for the pull tab 48.

It is also noted that bag 1 can be readily opened even if only one of gussets 6 and 7 is made peelable, i.e., if only one side gusset is provided with a release coat and at least one pull tab. However, in general, applications in which both of opposite gussets 6 and 7 are readily peelable are preferred, since bag 1 according to this arrangement is easily constructed and handled, and is more easily opened without searching.

Figure 4:
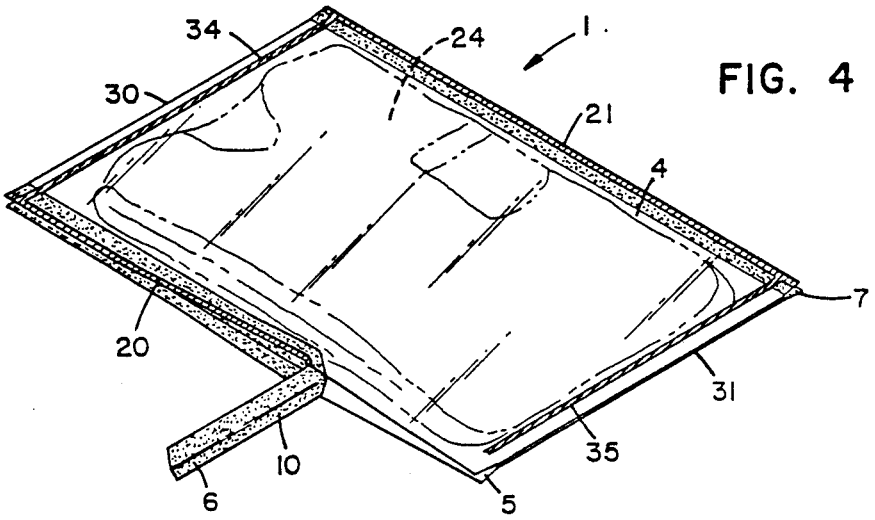
FIG. 4 is a perspective view of an arrangement according to the invention as illustrated in FIG. 1, shown partially opened.

The step of peeling a gusset, for example gusset 6, from between panels 4 and 5, will be best understood by comparison of FIGS. 1 and 4. In FIG. 4, gusset 6 is shown partly peeled or stripped from between panels 4 and 5. It will be readily understood that via this process, quick and easy access to article 24 within bag 1 can be readily obtained. From FIG. 4 it will be understood that advantages may be obtained even if the side gusset member is not stripped completely from association with the front and back panels. Therefore, when it is said herein that the side gusset is stripped "from between the panels" (or when similar statements are made) it is meant that the gusset is stripped sufficiently to open the bag for access to a stored item.

It is foreseen that in typical constructions, bag 1 will be prepared with seals 27 and 28 in place, and with one of seals 34 or 35 in place, prior to positioning an article 24 therein. After positioning of article 24 by passage through the open end (either 30 or 31,) the associated open end is then sealed closed.

It will be apparent that due to the non-integral (i.e. non-unitary) relationship between the gussets 6 and 7 and the panels 4 and 5, numerous advantages are obtained. The first of these, previously discussed, is that the gussets 6 and 7 can be constructed to be readily peelable or strippable from bag 1 for opening thereof. Another advantage is that unsightly seams in panels 4 and 5 are avoided. Yet another advantage is obtained from the fact that gussets 6 and 7 can be constructed from a material different than that used for panels 4 and 5. For example:

1. Strips 10 could be formed from a material having information indicia, advertising indicia or decorative indicia thereon. Production runs of bags 1 according to the present invention could be modified, for different indicia, by simply providing for different strips or gussets 6 and 7, without a change in the material used for panels 4 and 5.
2. The material utilized for gussets 6 and 7 could be made from a relatively strong, less flexible, material such as a metal foil or the like. Thus, in use gussets 6 and 7 could be folded open, to retain an open configuration, facilitating filling of an interior of bag 1 with material, especially relatively high profile material.
3. The material utilized for gussets 6 and 7, for certain preferred embodiments, can be a gas-permeable material, utilized to provide a bacteria filter for articles 24 stored within bag interior 23. Typically, conventional such gas-permeable materials comprising a high density spun bond polymeric material such as polypropylene or polyethylene would be utilized. One such material is available under the name TYVEK from DuPont. When the side gussets 6 and 7 are formed from such a material, bag 1 may be a readily sterilizable bag. That is, after an article 24 has been stored within interior 23, and the bag is sealed closed, the bag 1 and article 24 may be placed in a gaseous sterilizing environment such as an ethylene oxide environment. The ethylene oxide can readily permeate the gusset materials 6 and 7, to equilibrate within interior 23 and sterilize the environment thereof. The gas-permeable material, however, is generally sufficiently dense to prevent re-introduction of bacteria (contaminants) or the like, by acting as a filter therefor.

It will be generally understood that, especially for this last application of sterilization, bag constructions according to the present invention are particularly desirable. The expandable, accordion-like nature of the side gussets 6 and 7 facilitates wide open spreading and thus ease of gas introduction into bag interior 23. The easy opening, peelable, construction of the bag 1 facilitates operation in hospitals or the like, whereat access to contents such as surgical gowns, catheters, and other medical equipment stored within an interior of bag 1 may need to be accomplished within a brief period of time and completely by hand. The accordion-like nature of the side gussets 6 and 7 provides for a high profile on an interior of bag 1, and thus facilitates packaging therein of oddly configured or shaped articles. Positioning of gussets 6 and 7 on opposite sides 20 and 21 of bag 1 facilitates relatively rapid sterilizing gas introduction throughout all parts of interior 23 of bag 1.

It will be understood, however, that some advantages according to the present invention can be obtained from a construction 1 wherein gussets 6 and 7 are not formed from the same material. Also, a sterilizable bag can be made even with only one of gussets 6 or 7 comprising gas-permeable material. However, as indicated above, generally arrangements wherein both of side gussets 6 and 7 are gas-permeable, will be preferred.

Figure 5:
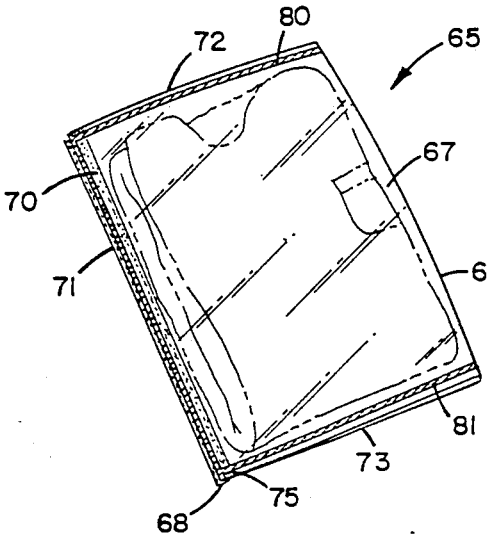
FIG. 5 is a perspective view of a bag or pouch construction according to a first alternate embodiment of the present invention.

In FIG. 5, an alternate bag construction 65 according to the present invention is illustrated. For the embodiment illustrated in FIG. 5, the bag 65 comprises a single panel member 67 having a single gusset 68 in association therewith. More specifically, panel member 67 comprises a unitary piece of material folded along edge line 69. Thus, there is no gusset member present along the side edge represented by edge line 69. A gusset member 68, analogous to gussets members 6 and 7, previously described, is fit in between edges 70 and 71 of panel 67. Seals analogous to those previously described for the preferred embodiment, are provided along opposite end edges 72 and 73, as well as between the gusset member 68 and the panel edges 70 and 71. As with the preferred embodiment, a peelable arrangement between the gusset member 68 and the panel 67 can be provided, including a peelable arrangement having an easily gripped tab extension 75, in gusset member 68, to facilitate opening. The gusset member 68 may be constructed from a variety of materials, including those as previously described, and especially including a gas-permeable material such as TYVEK or the like. In some applications, it may be desirable to form the arrangement of FIG. 5 with peelable end seams 80 and 81. Such an arrangement could be easily opened like a book, for removal of stored articles without risk of contact between the stored article and residue adhesive at the opened seams. It is noted that such a variation is possible for the arrangement of FIGS. 1–3 as well.

Figure 6:
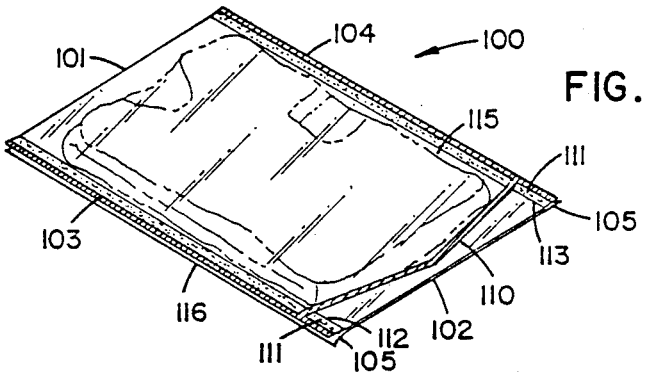
FIG. 6 is a perspective view of a bag or pouch construction according to a second alternate embodiment of the present invention.

In FIG. 6, yet another bag arrangement 100 according to the present invention is illustrated. Bag arrangement 100 includes end edges 101 and 102 and side edges 103 and 104. The side edges are sealed with gusset members 105 as previously described. Arrangement 100 is shown with only end 102 closed; however it will be understood that during use typically both ends 101 and 102 will be closed, at some point in the manufacturing process.

Still referring to FIG. 6, end 102 is closed by means of chevron seal 110. Thus, the embodiment of FIG. 6 demonstrates that an end seal need not be a strictly linear seal perpendicular to side edges 103 and 104. As a result of the chevron construction, relatively long tabs 111 are formed in areas 112 and 113, to facilitate opening through stripping of the gussets 105 from the bag 100.

In some circumstances, it may be desirable to form chevron seal 110 in a peelable manner. Thus, upper and lower panels 115 and 116 could be stripped apart from one another, along chevron seal 110. In this manner, articles held within the bag can be poured outwardly through end 102, when selected.

Spreading of panels 115 and 116 apart, along end seal 110, would be facilitated through use of side gussets according to the present invention. In particular, sections 111 and 112 of gussets 105 would be stripped back far enough to facilitate stripping of panels 115 and 116 from one another, along chevron seal 110.

It is to be understood that while certain embodiments of the present invention have been illustrated and described, it is not to be limited to the specific forms or arrangements herein described and shown.

What is claimed and desired to be secured by Letters Patent is as follows:

1. A bag arrangement comprising:

(a) a side panel arrangement including first and second, opposed, side panels defining first and second bag arrangement end edges and at least a first elongate side edge;

(b) an elongate gusset member positioned between said side panels and extending generally along said first elongate side edge;

(i) said gusset member having an elongate longitudinal hinge-fold therein; said hinge-fold defining: a central hinge-line oriented to project generally inwardly of said bag arrangement; and, first and second elongate gusset panels;

(ii) said gusset member being non-unitary with said panel arrangement and comprising a strip of gas-permeable material of sufficient density to function as a contaminant filter;

(c) first and second edge seam arrangements joining said gusset member to said first and second side panels; said first and second edge seam arrangements being peelable;

(d) a first end seam arrangement extending along a first one of said bag arrangement end edges; said first end seam arrangement including a central portion and first and second edge extensions;

(i) said first end seam arrangement central portion comprising a seam between said first and second side panels to substantially enclose a first of said bag arrangement end edges;

(ii) said first end seam arrangement first edge extension defining a peelable seam between said bag arrangement first side panel and said gusset member first gusset panel;

(iii) said first end seam arrangement second edge extension defining a peelable seam between said bag arrangement second side panel and said gusset member second gusset panel; and, (e) said gusset member including an end tab extension projecting beyond said first end seam arrangement first and second edge extensions in a direction of a first one of said end edges; said end tab extension being of sufficient length to be readily grippable by a user of said bag arrangement to strip said gusset member from between said first and second side panels of said bag arrangement.

2. A bag arrangement according to claim 1 wherein said gusset member end tab extension is at least about 0.5 inches long.

3. A bag arrangement according to claim 1 wherein gusset member end tab extension is between about 0.5 and 1.5 inches long.

4. A bag arrangement according to claim 1 including a second end seam arrangement extending along a second one of said bag arrangement end edges; said second end seam arrangement including a central portion and first and second edge extensions;

(a) said second end seam arrangement central portion comprising a seam between said first and second panels to substantially enclose a second of said bag arrangement end edges;

(b) said second end seam arrangement first edge extension defining a peelable seam between said bag arrangement first side panel and said gusset member first gusset panel;

(c) said second end seam arrangement second edge extension defining a peelable seam between said bag arrangement second side panel and said gusset member second gusset panel.

5. A bag arrangement according to claim 4 wherein said gusset member includes a second end tab extension projecting beyond said second end seam arrangement first and second edge extensions in a direction of a second one of said end edges; said second end tab being of sufficient length to be readily grippable by a user of said bag arrangement, to strip said gusset member from said bag arrangement.

6. A bag arrangement according to claim 5 wherein said gusset member second end tab extension is at least about 0.5 inches long.

7. A bag arrangement according to claim 1 wherein said side panel arrangement first and second side panels comprise sections of a single folded sheet of material.

8. A bag arrangement according to claim 1 wherein said side panel arrangement first and second side panels comprise first and second independent sheets of material.

9. A bag arrangement comprising:

(a) a side panel arrangement including first and second, opposed, side panels defining first and second bag arrangement end edges and at least a first elongate side edge;

(i) said side panel arrangement first and second side panels comprising sections of a single folded sheet of material;

(b) an elongate gusset member positioned between said side panels and extending generally along said first elongate side edge;

(i) said gusset member having an elongate longitudinal hinge-fold herein; said hinge-fold defining: a central hinge-line oriented to project generally inwardly of said bag arrangement; and, first and second elongate gusset panels;

(ii) said gusset member being non-unitary with said panel arrangement;

(c) first and second edge seam arrangements joining said gusset member to said first and second side panels; said first and second edge seam arrangements being peelable;

(d) a first end seam arrangement extending along a first one of said bag arrangement end edges; said first end seam arrangement including a central portion and first and second edge extensions;

(i) said first end seam arrangement central portion comprising a seam between said first and second side panels to substantially enclose a first of said bag arrangement end edges;

(ii) said first end seam arrangement first edge extension defining a peelable seam between said bag arrangement first side panel and said gusset member first gusset panel;

(iii) said first end seam arrangement second edge extension defining a peelable seam between said bag arrangement second side panel and said gusset member second gusset panel; and, (e) said gusset member including an end tab extension projecting beyond said first end seam arrangement first and second edge extensions in a direction of a first one of said end edges; said end tab extension being of sufficient length to be readily grippable by a user of said bag arrangement to strip said gusset member from between said first and second side panels of said bag arrangement.

10. A bag arrangement according to claim 9 wherein said gusset member end tab extension is at least about 0.5 inches long.

11. A bag arrangement according to claim 10 wherein gusset member end tab extension is between about 0.5 and 1.5 inches long.

12. A bag arrangement comprising:

(a) a side panel arrangement including first and second, independent, opposed, side panels defining first and second bag arrangement end edges, and first and second elongate side edges;

(b) a first elongate gusset member positioned between said side panels and extending generally along said first elongate side edge;

(i) said first gusset member having an elongate longitudinal hinge-fold therein; said hinge-fold defining: a central hinge-line oriented to project generally inwardly of said bag arrangement; and, first and second elongate gusset panels;

(ii) said first gusset member being non-unitary with said panel arrangement and comprising a strip of gas-permeable material of sufficient density to function as a contaminant filter;

(c) first and second seam arrangements joining said first gusset member to said first and second side panels; said first and second seam arrangements being peelable;

(d) a second elongate gusset member positioned between said side panels and extending generally along said bag arrangement second side edge;

(i) said second gusset member having an elongate longitudinal hinge-fold therein; said hinge-fold defining: a central hinge-line oriented to project generally inwardly of said bag arrangement; and, first and second elongate gusset panels;

(ii) said second gusset member being non-unitary with said panel arrangement; and (d) third and fourth seam arrangements joining said second gusset member to said first and second side panels;

(e) a first end seam arrangement extending along a first one of said bag arrangement end edges; said first end seam arrangement including a central portion and first, second, third and fourth edge extensions;

(i) said first end seam arrangement central portion comprising a seam between said first and second side panels to substantially close a first of said bag arrangement end edges between said first and second gusset members;

(ii) said first end seam arrangement first edge extension defining a peelable seam between said bag arrangement first side panel and said first gusset member first gusset panel; and, said first end seam arrangement second edge extension defining a peelable seam between said bag arrangement second side panel and said first gusset member second gusset panel;

(iii) said first end seam arrangement third edge extension defining a seam between said bag arrangement first side panel and said second gusset member first gusset panel; and, said first end seam arrangement fourth edge extension defining a seam between said bag arrangement second side panel and said second gusset member second gusset panel; and, (f) said first gusset member including a first end tab extension projecting beyond said first end seam arrangement first and second edge extensions; said first gusset member first end tab extension being of sufficient length to be readily grippable by a user of said bag arrangement, to strip said first gusset member from between said first and second side panels of said bag arrangement.

13. A bag arrangement according to claim 12 wherein said second gusset member is a strip of gas permeable material of sufficient density to function as a contaminant filter.

14. A bag arrangement according to claim 12 wherein said first gusset member first end tab extension is at least about 0.5 inches long.

15. A bag arrangement according to claim 14 wherein said first gusset member first end tab extension is between about 0.5 and 1.5 inches long.

16. A bag arrangement according to claim 12 wherein:

(a) said first end seam arrangement third and fourth edge extensions are peelable with respect to separation of said second gusset member from said first and second side panels; and, (b) said second gusset member includes a first end tab extension projecting beyond said first end seam arrangement third and fourth edge extensions; said second gusset member first end tab extension being of sufficient length to be readily grippable by a user of said bag arrangement, to strip said second gusset member from between said first and second side panels of said bag arrangement.

17. A bag arrangement according to claim 16 including a second end seam arrangement extending along a second one of said bag arrangement end edges; said second end seam arrangement including a central portion and first, second, third and fourth edge extensions;

(i) said first end seam arrangement central portion comprising a second end seam between said first and second side panels to substantially close said second one of said bag arrangement end edges between said first and second gusset members;

(ii) said second end seam arrangement first edge extension defining a peelable seam between said bag arrangement first side panel and said first gusset member first gusset panel; and, said second end seam arrangement second edge extension defining a peelable seam between said bag arrangement second side panel and said first gusset member second gusset panel; and, (iii) said second end seam arrangement third edge extension defining a seam between said bag arrangement first side panel and said second gusset member first gusset panel; and, said second end seam arrangement fourth edge extension defining a seam between said bag arrangement second side panel and said second gusset member second gusset panel.

18. A bag arrangement according to claim 17 wherein said side panel arrangement first and second side panels comprise first and second independent sheets of material.

19. A bag arrangement according to claim 17 wherein said second end seam arrangement third and fourth edge extensions each define a peelable seam with respect to said second gusset member.

20. A bag arrangement comprising:

(a) a side panel arrangement including first and second, opposed, side panels defining first and second bag arrangement end edges and at least a first elongate side edge;

(b) an elongate gusset member positioned between said side panels and extending generally along said first elongate side edge;

(i) said gusset member being non-unitary with said panel arrangement;

(ii) said gusset member comprising a strip of gas permeable material of sufficient density to function as a contaminant filter; and (iii) said gusset member having an elongate longitudinal hinge-fold therein;

(c) means joining said gusset member to said first and second side panels; and, (d) at least one of said gusset member and said side panel arrangement including a release coat having at least a portion thereof oriented along said bag arrangement first elongate side edge and between said gusset member and said side panel arrangement; said release coat providing for a readily peelable seam between said gusset member and said side panel arrangement.

21. A bag arrangement according to claim 20 wherein said side panel arrangement first and second side panels comprise portions of a single folded sheet of material.

22. A bag arrangement according to claim 21 wherein said side panel arrangement first and second side panels comprise first and second independent sheets of material.

23. A bag arrangement comprising:

(a) a side panel arrangement including first and second, opposed, side panels defining first and second bag arrangement end edges and at least a first elongate side edge;

(b) an elongate gusset member positioned between said side panels and extending generally along said first elongate side edge;

(i) said gusset member having an elongate longitudinal hinge-fold therein; said hinge-fold defining: a central hinge-line oriented to project generally inwardly of said bag arrangement; and, first and second elongate gusset panels;

(ii) said gusset member being non-unitary with said panel arrangement;

(iii) at least one of said gusset member and said side panel arrangement being provided with a release coat having at least a portion thereof oriented between said side panel arrangement first elongate side edge and said gusset member;

(c) first and second edge seam arrangements joining said gusset member to said first and second side panels; said first and second edge seam arrangements being readily peelable as a result of said release coat oriented between said side panel arrangement first elongate side edge and said gusset member;

(d) a first end seam arrangement extending along a first one of said bag arrangement end edges; said first end seam arrangement including a central portion and first and second edge extensions;

(i) said first end seam arrangement central portion comprising a seam between said first and second side panels to substantially enclose a first of said bag arrangement end edges;

(ii) at least one of said gusset member and said side panel arrangement including a release coat having at least a portion thereof oriented along said first end seam arrangement first edge extension and between said gusset member and said side panel arrangement; said first end seam arrangement first edge extension defining a readily peelable seam between said bag arrangement first side panel and said gusset member first gusset panel, as a result of said release coat along said first end seam arrangement first edge extension;

(iii) at least one of said gusset member and said side panel arrangement including a release coat with at least a portion thereof oriented along said first end seam arrangement second edge extension and between said gusset member and said side panel arrangement; said first end seam arrangement second edge extension defining a readily peelable seam between said bag arrangement second side panel and said gusset member second gusset panel, as a result of said release coat along said first end seam arrangement second edge extension; and, (e) said gusset member including an end tab extension projecting beyond said first end seam arrangement first and second edge extensions in a direction of a first one of said end edges; said end tab extension being at least about 0.5 inches long, so as to be readily grippable by a user of said bag arrangement to strip said gusset member from between said first and second side panels of said bag arrangement.

24. A bag arrangement according to claim 23 wherein said gusset member is a strip of gas-permeable material of sufficient density to function as a contaminant filter.

25. A bag arrangement according to claim 23 wherein gusset member end tab extension is between about 0.5 and 1.5 inches long.

26. A bag arrangement according to claim 23 wherein said side panel arrangement first and second side panels comprise sections of a single folded sheet of material.

27. A bag arrangement according to claim 23 wherein said side panel arrangement first and second side panels comprise first and second independent sheets of material.

28. A bag arrangement according to claim 23 wherein said gusset member is completely covered with said release coat.

29. A bag arrangement comprising:

(a) a side panel arrangement comprising a single folded sheet of material defining: first and second, opposed, side panels, first and second bag arrangement end edges; and, at least a first elongate side edge;

(b) an elongate gusset member positioned between said side panels and extending generally along said first elongate side edge;

(i) said gusset member being non-unitary with said panel arrangement; and, (ii) said gusset member having an elongate longitudinal hinge-fold therein;

(c) means joining said gusset member to said first and second side panels; and, (d) at least one of said gusset member and said side panel arrangement including a release coat having at least a portion thereof oriented along said bag arrangement first elongate side edge and between said gusset member and said side panel arrangement; said release coat providing for a readily peelable seam between said gusset member and said side panel arrangement.

* * * * *

UNITED STATES PATENT AND TRADEMARK OFFICE

CERTIFICATE OF CORRECTION

PATENT NO. : 4,936,456

DATED : June 26, 1990

INVENTOR(S) : Gary M. Bell et al.

It is certified that error appears in the above-identified patent and that said Letters Patent is hereby corrected as shown below:

Column 2, line 6 "recontaminating" should read --re-contaminating--.

Column 3, line 21 "highprofile" should read --high-profile--.

Column 5, line 35 "is" should read --and--.

Column 13, line 20 "first" should read --second--.

Signed and Sealed this

Fifth Day of October, 1993

*Attest:*

Bruce Lehman

BRUCE LEHMAN

*Attesting Officer*

*Commissioner of Patents and Trademarks*